US009484648B2

(12) United States Patent
Takenaga et al.

(10) Patent No.: US 9,484,648 B2
(45) Date of Patent: Nov. 1, 2016

(54) CONNECTOR

(71) Applicants: JAPAN AVIATION ELECTRONICS INDUSTRY, LIMITED, Shibuya-ku, Tokyo (JP); JAE ELECTRONICS, INC., Irvine, CA (US)

(72) Inventors: Yuichi Takenaga, Tokyo (JP); Hiroaki Obikane, Tokyo (JP); Takayuki Nishimura, Tokyo (JP); Daisuke Machihara, Irvine, CA (US); Yutaro Mori, Tokyo (JP)

(73) Assignees: JAPAN AVIATION ELECTRONICS INDUSTRY, LIMITED, Tokyo (JP); JAE ELECTRONICS, INC., Irvine, CA (US)

( * ) Notice: Subject to any disclaimer, the term of this patent is extended or adjusted under 35 U.S.C. 154(b) by 0 days.

(21) Appl. No.: 14/734,433

(22) Filed: Jun. 9, 2015

(65) Prior Publication Data

US 2016/0093967 A1 Mar. 31, 2016

Related U.S. Application Data

(60) Provisional application No. 62/055,996, filed on Sep. 26, 2014.

(51) Int. Cl.
*H01R 12/71* (2011.01)
*H01R 13/405* (2006.01)
(Continued)

(52) U.S. Cl.
CPC ..... *H01R 12/716* (2013.01); *H01R 13/405* (2013.01); *H01R 12/57* (2013.01); *H01R 12/707* (2013.01)

(58) Field of Classification Search
CPC ..... H01R 12/716
USPC ..... 439/74
See application file for complete search history.

(56) References Cited

U.S. PATENT DOCUMENTS 5,498,167 A * 3/1996 Seto ..... H01R 12/716 439/284
5,876,217 A * 3/1999 Ito ..... H01R 13/20 439/74
(Continued)

FOREIGN PATENT DOCUMENTS

JP 2004127572 A 4/2004
JP 2006302901 A 11/2006
(Continued)

OTHER PUBLICATIONS

Taiwanese Office Action (and English translation thereof) dated Jun. 14, 2016, issued in counterpart Taiwanese Application No. 104121063.

*Primary Examiner* — Ross Gushi
(74) *Attorney, Agent, or Firm* — Holtz, Holtz & Volek PC

(57) ABSTRACT

Disclosed is a connector mateable with a mating connector along a first direction. The connector comprises a housing and a plurality of terminals, wherein the housing includes a plurality of held portions, and the terminals correspond to the held portions, respectively. Each of the terminals includes a base portion, a first portion, a second portion and a third portion. The first portion extends directly from the base portion and is provided with a first contact portion which projects towards the second portion in a second direction perpendicular to the first direction. The second portion extends directly from the base portion and is provided with a second contact portion and a press-fitting projection. The second contact portion projects towards the first portion in the second direction and faces the first contact portion. The press-fitting projection projects towards the third portion in the second direction. The third portion extends directly from the base portion. Each of the held portions is held by the second portion and the third portion of the terminal corresponding thereto.

5 Claims, 14 Drawing Sheets

(51) Int. Cl.
*H01R 12/57* (2011.01)
*H01R 12/70* (2011.01)

(56) References Cited

U.S. PATENT DOCUMENTS 5,885,092 A * 3/1999 Ito ..... H01R 12/716 439/74
5,888,076 A * 3/1999 Itoh ..... G02F 1/13452 439/74
5,931,689 A * 8/1999 Patel ..... H01R 13/20 439/346
5,975,916 A * 11/1999 Okura ..... H01R 12/716 439/660
6,135,785 A * 10/2000 Niitsu ..... H01R 12/716 439/74
6,257,900 B1 * 7/2001 Huang ..... H01R 12/716 439/74
6,276,942 B1 * 8/2001 Hsiao ..... H01R 13/26 439/74
6,296,524 B1 * 10/2001 Goto ..... H01R 9/091 439/660
6,338,630 B1 * 1/2002 Dong ..... H01R 13/26 439/74
6,464,515 B1 * 10/2002 Wu ..... H01R 13/65802 439/108
6,540,561 B1 * 4/2003 Masumoto ..... H01R 13/20 439/660
6,623,308 B2 * 9/2003 Ono ..... H01R 13/26 439/660
6,692,266 B2 * 2/2004 Hashiguchi ..... H01R 12/716 439/733.1
6,764,314 B1 * 7/2004 Lee ..... H01R 12/57 439/65
6,793,506 B1 * 9/2004 Hirata ..... H01R 12/716 439/65
6,811,411 B1 * 11/2004 Hirata ..... H01R 12/716 439/660
6,827,588 B1 * 12/2004 Huang ..... H01R 12/716 439/74
6,846,187 B2 * 1/2005 Yu ..... H01R 13/20 439/346
6,881,075 B2 * 4/2005 Huang ..... H01R 12/716 439/660
6,884,089 B2 * 4/2005 Obikane ..... H01R 12/707 439/571
6,923,659 B2 * 8/2005 Zhang ..... H01R 12/716 439/74
6,976,853 B2 * 12/2005 Goto ..... H01R 12/716 439/660
6,986,670 B2 * 1/2006 Okura ..... H01R 13/6275 439/74
7,037,117 B2 * 5/2006 Goto ..... H01R 12/716 439/660
7,070,423 B2 * 7/2006 Zhang ..... H01R 12/716 439/74
7,070,424 B2 * 7/2006 Obikane ..... H01R 13/6471 439/74
7,074,085 B2 * 7/2006 Chen ..... H01R 23/6873 439/108
7,090,508 B1 * 8/2006 Chen ..... H01R 13/26 439/357
7,112,091 B2 * 9/2006 Okura ..... H01R 13/6275 439/570
7,118,388 B2 * 10/2006 Midorikawa ..... H01R 12/716 439/74
7,125,260 B2 * 10/2006 Orita ..... H01R 12/57 439/247
7,128,581 B2 * 10/2006 Igarashi ..... H01R 12/716 439/660
7,144,277 B2 * 12/2006 Pan ..... H01R 12/716 439/374
7,172,433 B2 * 2/2007 Tsai ..... H01R 12/716 439/660
7,172,434 B2 * 2/2007 Obikane ..... H01R 24/60 439/570
7,195,494 B2 * 3/2007 Ookura ..... H01R 12/716 439/74
7,195,495 B2 * 3/2007 Takano ..... H01R 12/716 439/660
7,232,317 B2 * 6/2007 Ookura ..... H01R 13/506 439/660
7,247,029 B2 * 7/2007 Chen ..... H01R 12/716 439/66
7,278,861 B2 * 10/2007 Kishi ..... H01R 12/716 439/74
7,287,988 B1 * 10/2007 Peng ..... H01R 12/52 439/74
7,320,605 B2 * 1/2008 Chang ..... H01R 12/57 439/284
7,320,606 B2 * 1/2008 Midorikawa ..... H01R 12/716 439/660
7,338,318 B2 * 3/2008 Shen ..... H01R 12/79 439/571
7,344,386 B2 * 3/2008 Michida ..... H01R 13/26 439/74
7,344,387 B2 * 3/2008 Shiroyama ..... H01R 13/20 439/660
7,354,279 B2 * 4/2008 Uesaka ..... H01R 12/57 439/660
7,367,816 B2 * 5/2008 Liu ..... H01R 13/26 439/74
7,374,432 B2 * 5/2008 Koguchi ..... H01R 12/725 439/247
7,377,803 B2 * 5/2008 Matsuoka ..... H01R 12/592 439/497
7,384,274 B1 * 6/2008 Chen ..... H01R 12/714 439/74
7,387,540 B1 * 6/2008 Van der Steen ..... H01R 12/57 439/566
7,390,196 B2 * 6/2008 Sasaki ..... H01R 13/20 439/74
7,402,054 B2 * 7/2008 Peng ..... H01R 13/6271 439/74
7,410,364 B2 * 8/2008 Kishi ..... H01R 12/716 439/566
7,413,444 B2 * 8/2008 Wang ..... H01R 13/415 439/660
7,425,158 B2 * 9/2008 Ookura ..... H01R 12/707 439/660
7,445,466 B1 * 11/2008 Peng ..... H01R 23/72 439/570
7,445,514 B2 * 11/2008 Cao ..... H01R 13/41 439/603
7,465,171 B2 * 12/2008 Miyazaki ..... H01R 13/20 439/74
7,467,954 B2 * 12/2008 Shiu ..... H01R 12/57 439/660
7,484,969 B2 * 2/2009 Shiu ..... H01R 12/716 439/660
7,494,346 B1 * 2/2009 Peng ..... H01R 12/716 439/66
7,497,697 B2 * 3/2009 Hoshino ..... H01R 13/629 439/74
7,547,236 B1 * 6/2009 Chen ..... H01R 13/506 439/660
7,568,919 B2 * 8/2009 Hoshino ..... H01R 12/716 439/74
7,585,185 B2 * 9/2009 Obikane ..... H01R 13/65802 439/108
7,588,443 B2 * 9/2009 Wu ..... H01R 12/52 439/74
7,591,652 B2 * 9/2009 Goto ..... H01R 12/57 439/74
7,625,244 B2 * 12/2009 Midorikawa ..... H01R 4/028 439/66
7,635,274 B2 * 12/2009 Fukazawa ..... H01R 12/716 439/247
7,637,786 B2 * 12/2009 Hoshino ..... H01R 4/028 439/660
7,658,636 B2 * 2/2010 Takeuchi ..... H01R 13/6275 439/357
7,674,115 B2 * 3/2010 Midorikawa ..... H01R 12/716 439/74

(56) References Cited

U.S. PATENT DOCUMENTS 7,674,135 B2 * 3/2010 Zeng ..... H01R 13/26 439/660
7,677,903 B1 * 3/2010 Huang ..... H01R 13/112 439/64
7,717,719 B2 * 5/2010 Miyazaki ..... H01R 12/57 439/74
7,722,408 B2 * 5/2010 Miyazaki ..... H01R 13/516 439/570
7,726,979 B2 * 6/2010 Lei ..... H01R 12/716 439/74
7,736,177 B2 * 6/2010 Tsai ..... H01R 12/57 439/570
7,744,377 B2 * 6/2010 Wu ..... H01R 12/716 439/74
7,748,993 B2 * 7/2010 Midorikawa ..... H01R 13/20 439/74
7,748,994 B1 * 7/2010 Peng ..... H01R 13/6315 439/660
7,758,352 B2 * 7/2010 Zeng ..... H01R 13/26 439/346
RE41,473 E * 8/2010 Hirata ..... H01R 12/716 439/660
7,766,666 B1 * 8/2010 Chen ..... H01R 13/20 439/65
7,789,673 B2 * 9/2010 Lee ..... H01R 13/428 439/74
7,794,238 B2 * 9/2010 Chen ..... H01R 13/20 439/660
7,828,559 B2 * 11/2010 Chen ..... H01R 12/716 439/74
7,833,024 B2 * 11/2010 Takeuchi ..... H01R 13/432 439/74
7,835,160 B2 * 11/2010 Yamamoto ..... H05K 1/0233 174/261
7,845,958 B2 * 12/2010 Hoshino ..... H01R 12/716 439/660
7,845,987 B2 * 12/2010 Yamada ..... H01R 12/716 439/680
7,901,218 B2 * 3/2011 Sato ..... H01R 12/716 439/74
7,922,499 B2 * 4/2011 Liao ..... H01R 12/714 439/660
7,931,477 B2 * 4/2011 Hirata ..... H01R 12/716 439/74
7,946,888 B2 * 5/2011 Wu ..... H01R 12/716 439/626
7,950,929 B2 * 5/2011 Yu ..... H01R 12/716 439/660
7,985,099 B2 * 7/2011 Wu ..... H01R 12/57 439/626
7,993,146 B2 * 8/2011 Midorikawa ..... H01R 12/57 439/74
8,083,527 B2 * 12/2011 Takeuchi ..... H01R 13/26 439/65
8,087,942 B2 * 1/2012 Chen ..... B41J 13/12 439/74
8,092,232 B2 * 1/2012 Takeuchi ..... H01R 12/716 439/74
8,105,112 B2 * 1/2012 Midorikawa ..... H01R 12/716 439/607.35
8,109,771 B2 * 2/2012 Chen ..... H01R 23/72 439/74
8,182,272 B2 * 5/2012 Ooi ..... H01R 12/716 439/660
8,235,733 B2 * 8/2012 Yamashiro ..... H01R 12/57 439/74
8,267,698 B2 * 9/2012 Ishikawa ..... H01R 12/716 439/17
8,272,881 B2 * 9/2012 Miyazaki ..... H01R 13/20 439/345
8,292,635 B2 * 10/2012 Little ..... H01R 12/7029 439/570
8,308,492 B2 * 11/2012 Takeuchi ..... H01R 12/716 439/74
8,337,218 B2 * 12/2012 Hirata ..... H01R 13/41 439/660
8,342,875 B2 * 1/2013 Takeuchi ..... H01R 12/716 439/374
8,398,425 B2 * 3/2013 Suzuki ..... H01R 12/716 439/374
8,408,931 B2 * 4/2013 Sato ..... H01R 12/7052 439/357
8,465,298 B2 * 6/2013 Takeuchi ..... H01R 13/6275 439/74
8,469,722 B2 * 6/2013 Huang ..... H01R 12/716 439/74
8,475,184 B2 * 7/2013 Hasegawa ..... H01R 13/112 439/345
8,485,832 B2 * 7/2013 Mashiyama ..... H01R 12/73 439/74
8,500,460 B2 * 8/2013 Huang ..... H01R 12/716 439/74
8,523,580 B2 * 9/2013 Midorikawa ..... H01R 12/73 439/74
8,540,534 B2 * 9/2013 Sato ..... H01R 13/11 439/660
8,556,640 B2 * 10/2013 Mashiyama ..... H01R 12/73 439/74
8,562,379 B2 * 10/2013 Miyazaki ..... H01R 12/716 439/660
8,758,029 B2 * 6/2014 Midorikawa ..... H01R 13/2407 439/74
8,764,470 B2 * 7/2014 Little ..... H01R 12/716 439/284
8,790,122 B2 * 7/2014 Malehorn, II ..... H01R 23/27 439/83
8,827,724 B2 * 9/2014 Takeuchi ..... H01R 12/716 439/74
8,840,406 B2 * 9/2014 Hirata ..... H01R 13/26 439/74
8,840,407 B2 * 9/2014 Nose ..... H01R 12/716 439/607.35
8,840,433 B2 * 9/2014 Ho ..... H01R 4/02 439/626
8,858,239 B2 * 10/2014 Little ..... H01R 13/28 439/74
8,888,506 B2 * 11/2014 Nishimura ..... H01R 12/7082 439/74
8,888,507 B2 * 11/2014 Chen ..... H01R 12/712 439/74
8,968,005 B2 * 3/2015 Hirakawa ..... H01R 12/73 439/65
8,979,551 B2 * 3/2015 Mongold ..... H01R 12/73 439/74
8,986,027 B2 * 3/2015 Nishimura ..... H01R 12/707 439/181
8,992,233 B2 * 3/2015 Miyazaki ..... H01R 12/707 439/74
8,992,234 B2 * 3/2015 Yoshioka ..... H01R 12/716 439/74
9,039,428 B2 * 5/2015 Sasaki ..... H01R 12/716 439/74
9,048,554 B2 * 6/2015 Tagawa ..... H01R 12/707
9,065,228 B2 * 6/2015 Nishimura ..... H01R 12/79
9,077,102 B2 * 7/2015 Miyazaki ..... H01R 12/707
9,124,011 B2 * 9/2015 Miyazaki ..... H01R 12/716
9,147,969 B2 * 9/2015 Takenaga ..... H01R 13/6275
9,153,892 B2 * 10/2015 Tanaka ..... H01R 12/7052
9,160,105 B2 * 10/2015 Takaki ..... H01R 12/716
9,178,309 B2 * 11/2015 Tanaka ..... H01R 13/631
9,190,750 B2 * 11/2015 Takeuchi ..... H01R 12/716
9,190,751 B2 * 11/2015 Miyazaki ..... H01R 12/716
9,190,752 B1 * 11/2015 Little ..... H01R 12/716
9,196,982 B2 * 11/2015 Sasaki ..... H01R 12/716
9,203,172 B2 * 12/2015 Kubo ..... H01R 12/73
9,209,541 B2 * 12/2015 Miyazaki ..... H01R 12/707
9,214,748 B2 * 12/2015 Chen ..... H01R 12/716
9,225,086 B2 * 12/2015 Takeuchi ..... H01R 12/716
9,240,654 B2 * 1/2016 Takemoto ..... H01R 12/7029
9,246,279 B2 * 1/2016 Kato ..... H01R 13/6596
9,252,517 B2 * 2/2016 Kimura ..... H01R 12/85
9,257,766 B2 * 2/2016 Takemoto ..... H01R 12/716
9,270,045 B2 * 2/2016 Kimura ..... H01R 13/41

(56) References Cited

U.S. PATENT DOCUMENTS 9,270,065 B2 * 2/2016 Fang ..... H01R 12/716
9,281,586 B2 * 3/2016 Miyazaki ..... H01R 12/707
9,281,587 B2 * 3/2016 Komoto ..... H01R 12/714
9,281,594 B2 * 3/2016 Funayama ..... H01R 12/91
2001/0027036 A1 * 10/2001 Goto ..... H01R 12/716 439/74
2004/0063344 A1 * 4/2004 Shin ..... H01R 12/716 439/74
2004/0171285 A1 * 9/2004 Okura ..... H01R 13/20 439/74
2004/0185690 A1 * 9/2004 Huang ..... H01R 13/26 439/74
2005/0026466 A1 * 2/2005 Kubo ..... H01R 13/6275 439/74
2005/0070137 A1 * 3/2005 Goto ..... H01R 12/716 439/74
2005/0101163 A1 * 5/2005 Obikane ..... H01R 13/6471 439/74
2005/0191877 A1 * 9/2005 Huang ..... H01R 12/716 439/74
2006/0051988 A1 * 3/2006 Okura ..... H01R 13/6275 439/74
2006/0141811 A1 * 6/2006 Shichida ..... H01R 24/50 439/63
2006/0178022 A1 * 8/2006 Liu ..... H01R 13/26 439/74
2006/0264075 A1 * 11/2006 Obikane ..... H01R 24/60 439/74
2006/0276060 A1 * 12/2006 Takano ..... H01R 12/7005 439/74
2007/0020966 A1 * 1/2007 Lee ..... H01R 12/716 439/74
2007/0173131 A1 * 7/2007 Chen ..... H01R 12/716 439/660
2008/0026609 A1 * 1/2008 Kuwana ..... H01R 12/716 439/74
2008/0305657 A1 * 12/2008 Midorikawa ..... H01R 4/028 439/74
2009/0176386 A1 * 7/2009 Wu ..... H01R 12/716 439/74
2009/0197440 A1 * 8/2009 Hirata ..... H01R 12/57 439/83
2009/0227138 A1 * 9/2009 Lv ..... H01R 12/79 439/466
2009/0325396 A1 * 12/2009 Takeuchi ..... H01R 12/716 439/65
2010/0130068 A1 * 5/2010 Peng ..... H01R 13/2457 439/660
2010/0230709 A1 * 9/2010 Kanno ..... H01R 13/20 257/99
2010/0291776 A1 * 11/2010 Huang ..... H01R 13/2457 439/74
2011/0111648 A1 * 5/2011 Takeuchi ..... H01R 12/716 439/884
2011/0250800 A1 * 10/2011 Guo ..... H01R 12/716 439/660
2012/0003875 A1 * 1/2012 Akai ..... H01R 12/716 439/660
2012/0052711 A1 * 3/2012 Hasegawa ..... H01R 13/112 439/345
2012/0122350 A1 * 5/2012 Choi ..... H01R 13/20 439/660
2012/0142226 A1 * 6/2012 Funayama ..... H01R 12/716 439/692
2012/0214353 A1 * 8/2012 Midorikawa ..... H01R 13/2407 439/733.1
2012/0231637 A1 * 9/2012 Takeuchi ..... H01R 12/716 439/65
2013/0005192 A1 * 1/2013 Lim ..... H01R 13/65807 439/660
2013/0012039 A1 * 1/2013 Nose ..... H01R 12/716 439/74
2013/0023162 A1 * 1/2013 Harlan ..... H01R 12/73 439/660
2013/0065460 A1 * 3/2013 Hirata ..... H01R 13/26 439/884
2013/0137304 A1 * 5/2013 Huang ..... H01R 13/20 439/626
2013/0137307 A1 * 5/2013 Huang ..... H01R 12/716 439/660
2013/0137308 A1 * 5/2013 Chiang ..... H01R 12/716 439/660
2013/0149908 A1 * 6/2013 Little ..... H01R 12/716 439/660
2013/0203272 A1 * 8/2013 Miyazaki ..... H01R 12/707 439/65
2013/0210270 A1 * 8/2013 Takeuchi ..... H01R 12/716 439/488
2013/0210281 A1 * 8/2013 Huang ..... H01R 12/716 439/638
2013/0217270 A1 * 8/2013 Miyazaki ..... H01R 12/716 439/660
2013/0260587 A1 * 10/2013 Chen ..... H01R 12/712 439/284
2013/0260588 A1 * 10/2013 Chen ..... H01R 12/712 439/284
2013/0260589 A1 * 10/2013 Chen ..... H01R 12/712 439/284
2013/0309895 A1 * 11/2013 Nishimura ..... H01R 13/62 439/345
2013/0316598 A1 * 11/2013 Yoshioka ..... H01R 12/716 439/733.1
2013/0330943 A1 * 12/2013 Sasaki ..... H01R 12/716 439/74
2013/0330970 A1 * 12/2013 Hirata ..... H01R 12/716 439/620.01
2014/0094072 A1 * 4/2014 Seki ..... H01R 13/03 439/887
2014/0099804 A1 * 4/2014 Kobuchi ..... H01R 12/716 439/66
2014/0120780 A1 * 5/2014 Nishimura ..... H01R 12/707 439/660
2014/0187059 A1 * 7/2014 Takemoto ..... H01R 12/88 439/65
2014/0256195 A1 * 9/2014 Obikane ..... H01R 13/02 439/700
2014/0287610 A1 * 9/2014 Komoto ..... H01R 13/627 439/350
2014/0363991 A1 * 12/2014 Ryan ..... H01R 12/716 439/74
2014/0364003 A1 * 12/2014 Yunoki ..... H01R 12/716 439/374
2014/0370726 A1 * 12/2014 Kato ..... H01R 12/716 439/84
2015/0031233 A1 * 1/2015 Takaki ..... H01R 13/52 439/374
2015/0079816 A1 * 3/2015 Suzuki ..... H01R 12/716 439/74
2015/0079853 A1 * 3/2015 Tsai ..... H01R 12/73 439/751
2015/0140841 A1 * 5/2015 Watanabe ..... H01R 12/7011 439/74
2015/0194753 A1 * 7/2015 Raff ..... H01R 12/716 439/75
2015/0207248 A1 * 7/2015 Takenaga ..... H01R 12/716 439/74
2015/0214643 A1 * 7/2015 Lee ..... H01R 12/716 439/655
2015/0214681 A1 * 7/2015 Nakamura ..... H01R 24/68 439/374
2015/0222044 A1 * 8/2015 Arai ..... H01R 13/5219 439/271
2015/0263464 A1 * 9/2015 Arichika ..... H01R 13/6271 439/374
2015/0270633 A1 * 9/2015 Kodaira ..... H01R 12/79 439/357
2015/0270641 A1 * 9/2015 Omodachi ..... H01R 12/707 439/374
2015/0270658 A1 * 9/2015 Aoki ..... H01R 4/48 439/660
2015/0303597 A1 * 10/2015 He ..... H01R 12/716 439/345

(56) References Cited

U.S. PATENT DOCUMENTS

2015/0357729 A1* 12/2015 Uratani ..... H01R 12/716
439/585
2015/0357735 A1* 12/2015 Uratani ..... H01R 13/6473
439/660
2015/0380845 A1* 12/2015 Goto ..... H01R 12/73
439/660
2016/0013573 A1* 1/2016 Miyazaki ..... H01R 12/716
439/626

FOREIGN PATENT DOCUMENTS

JP 2009032425 A 2/2009
JP 2012079567 A 4/2012

* cited by examiner

CONNECTOR

CROSS REFERENCE TO RELATED APPLICATIONS

This application claims the benefit of U.S. Provisional Application No. 62/055,996 filed Sep. 26, 2014, the contents of which are herein incorporated by reference in its entirety.

BACKGROUND OF THE INVENTION

This invention relates to a connector which is to be mounted on a circuit board and is mateable with a mating connector mounted on a mating circuit board.

As shown in FIG. 27, Patent Document 1 discloses a connector 900 and a mating connector 950 which are mounted on a circuit board 910 and a mating circuit board 960, respectively. The connector 900 comprises a housing 920 made of insulator and a plurality of terminals 930 each made of conductor. The housing 920 is formed of press-fit holes 925. The terminals 930 are provided with press-fitting portions 935, respectively. The press-fitting portions 935 are press-fit into the press-fit holes 925, respectively, so that the terminals 930 are held by the housing 920. In order to prevent the housing 920 from being broken upon the press-fitting of the press-fitting portions 935 into the press-fit holes 925, the housing 920 has thicker thickness to secure a certain strength. The mating connector 950 comprises a mating housing 970 made of insulator and a plurality of mating terminals 980 each made of conductor. The mating terminals 980 are held by the mating housing 970.

[Patent Document 1] JP 2006-302901 A, FIG. 2

SUMMARY OF THE INVENTION

It is an object of the present invention to provide a connector which is more downsized.

One aspect of the present invention provides a connector which is mateable with a mating connector along a first direction. The connector comprises a housing and a plurality of terminals, wherein the housing includes a plurality of held portions, and the terminals correspond to the held portions, respectively. Each of the terminals includes a base portion, a first portion, a second portion and a third portion. The first portion extends directly from the base portion and is provided with a first contact portion which projects towards the second portion in a second direction perpendicular to the first direction. The second portion extends directly from the base portion and is provided with a second contact portion and a press-fitting projection. The second contact portion projects towards the first portion in the second direction and faces the first contact portion. The press-fitting projection projects towards the third portion in the second direction. The third portion extends directly from the base portion. Each of the held portions is held by the second portion and the third portion of the terminal corresponding thereto.

Each of the terminals has no portion press-fit into the housing. Instead, the housing is provided with the held portions, each of which is inserted between the second portion and the third portion of the terminal corresponding thereto, so as to be held by the second portion and the third portion. Therefore, the housing is not required to have thickness same as that of the connector of Patent Document 1. The housing can be downsized, and accordingly, the connector can be downsized.

An appreciation of the objectives of the present invention and a more complete understanding of its structure may be had by studying the following description of the preferred embodiment and by referring to the accompanying drawings.

Figure 1:
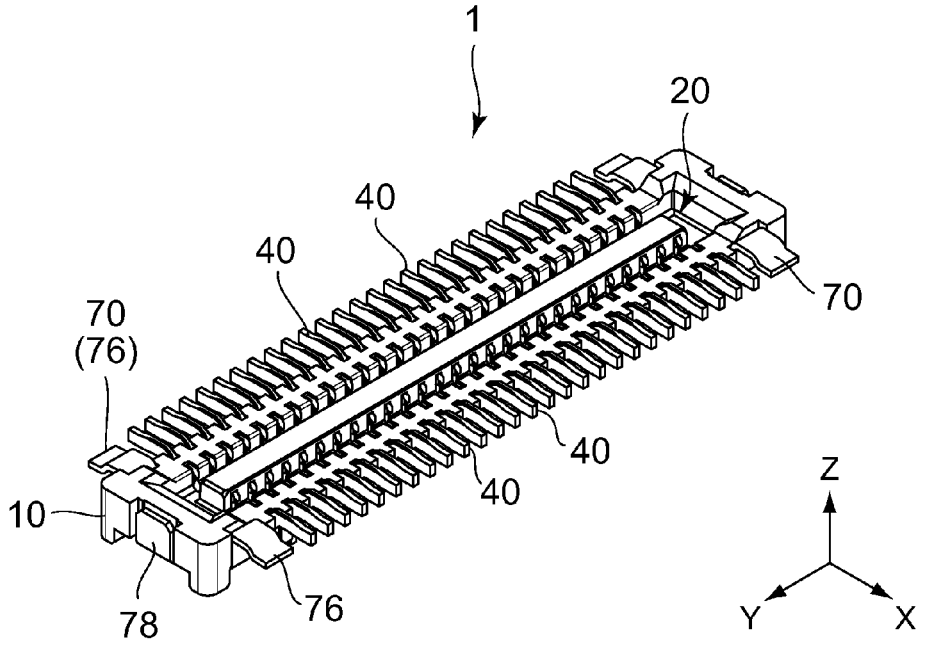
FIG. 1 is a top oblique view showing a connector in accordance with a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 4:
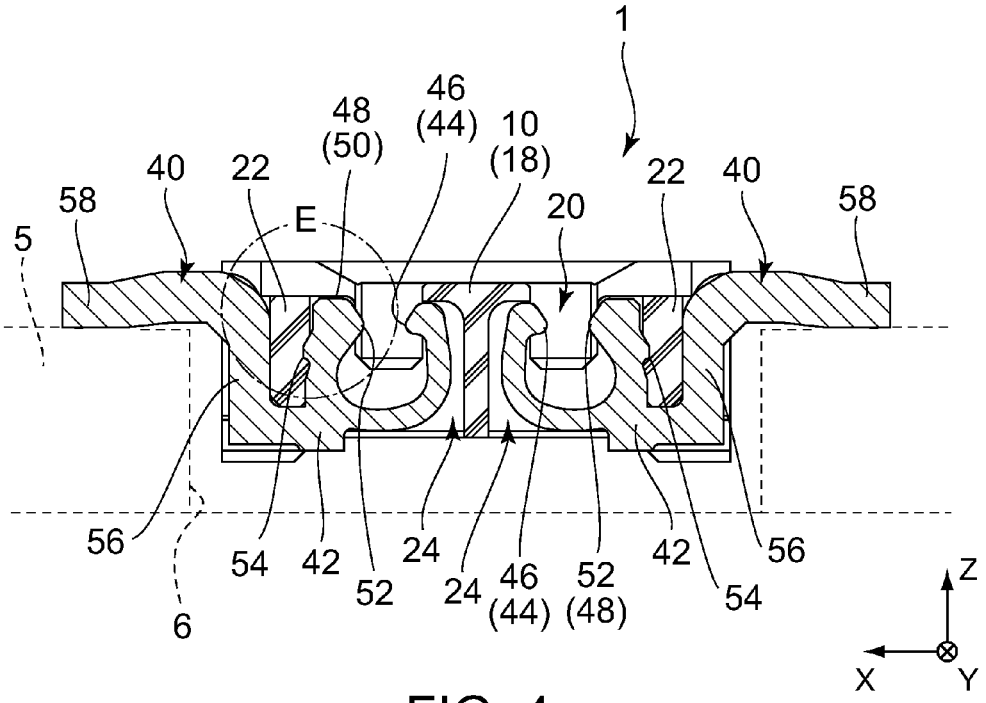
FIG. 4 is a cross-sectional view showing the connector of FIG. 3, taken along line A-A.
Figure 15:
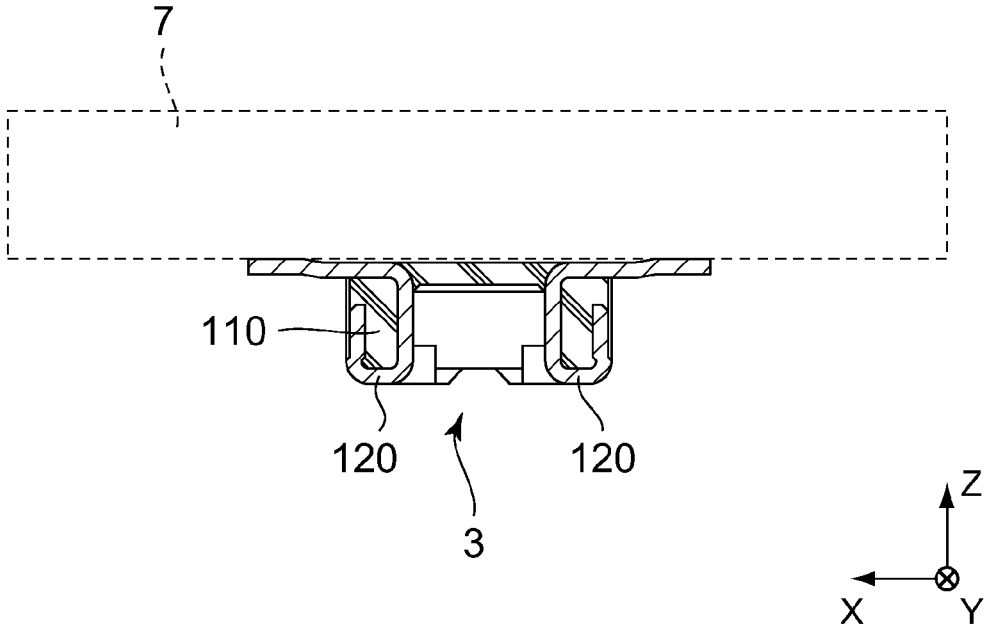
FIG. 15 is a cross-sectional view showing a mating connector.

With reference to FIG. 4, a connector 1 according to a first embodiment of the present invention is to be mounted and fixed to a circuit board 5. Specifically, the circuit board 5 of the present embodiment is formed with a hollow portion 6. When mounted to the circuit board 5, the connector 1 is partially accommodated within the hollow portion 6. As understood from FIGS. 4, 15 and 16, the connector 1 is to be mated with a mating connector 3 along a Z-direction (first direction). As shown in FIG. 15, the mating connector 3 is to be mounted and fixed to a mating circuit board 7. As understood from the above, the connector 1 and the mating connector 3 constitute a board-to-board connector assembly. As shown in FIG. 15, the mating connector 3 comprises a mating housing 110 and a plurality of mating terminals 120. The mating terminals 120 are held by the mating housing 110.

Figure 2:
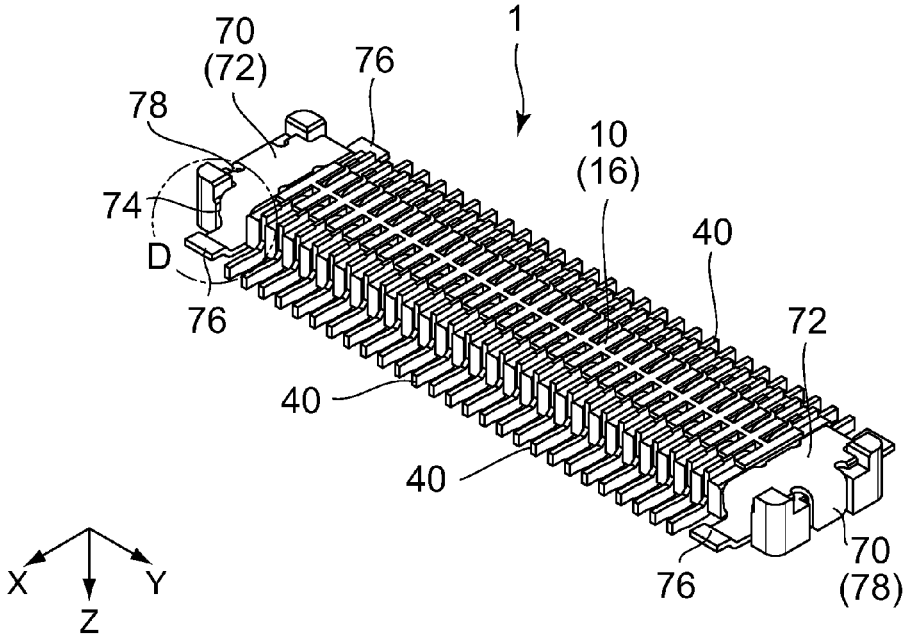
FIG. 2 is a bottom oblique view showing the connector of FIG. 1.
Figure 3:
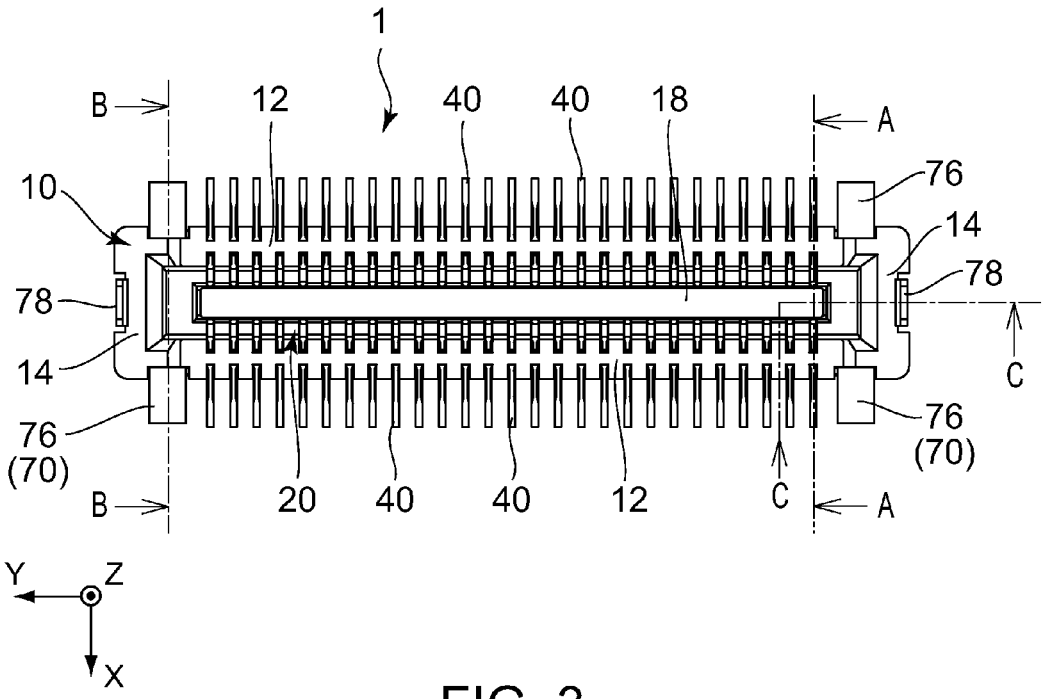
FIG. 3 is a top plan view showing the connector of FIG. 1.

With reference to FIGS. 1 to 3, the connector 1 comprises a housing 10 made of insulator, a plurality of terminals 40 each made of conductor and two reinforcement members 70 each made of metal.

Figure 9:
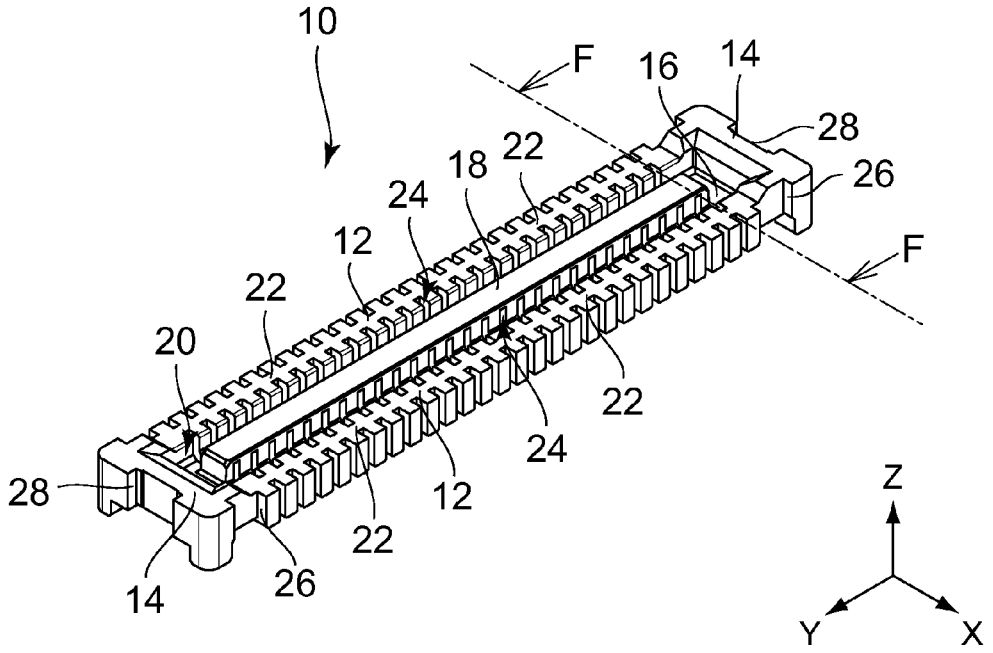
FIG. 9 is a top oblique view showing a housing included in the connector of FIG. 1.

As shown in FIG. 9, the housing 10 includes two first wall portions 12, two second wall portions 14, a bottom portion 16 and an island portion 18. The first wall portions 12 are positioned away from each other in an X-direction (second direction). Each of the first wall portions 12 extends long in a Y-direction (third direction). Each first wall portion 12 is provided with a plurality of held portions 22. As understood from FIGS. 1, 4 and 9, the held portions 22 correspond to the terminals 40, respectively. As shown in FIG. 9, the second wall portions 14 are positioned away from each other in the Y-direction. Each of the second wall portions 14 connects the first wall portions 12 in the X-direction. The island portion 18 protrudes from the bottom portion 16 in the Z-direction. The island portion 18 extends long in the Y-direction. Between the island portion 18 and the first wall portions 12 as well as the second wall portions 14, a receiving portion 20 is formed. Each of the first wall portions 12 of the present embodiment has a length of about 12 mm in the Y-direction and has a thickness of about 0.2 mm in the X-direction. As apparent from the above, the connector 1 is extremely small.

Figure 10:
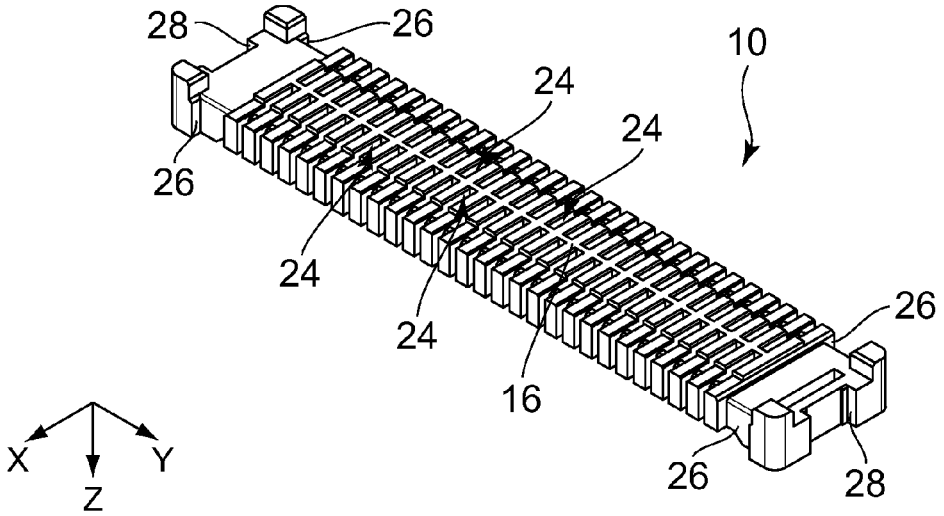
FIG. 10 is a bottom oblique view showing the housing of FIG. 9.
Figure 11:
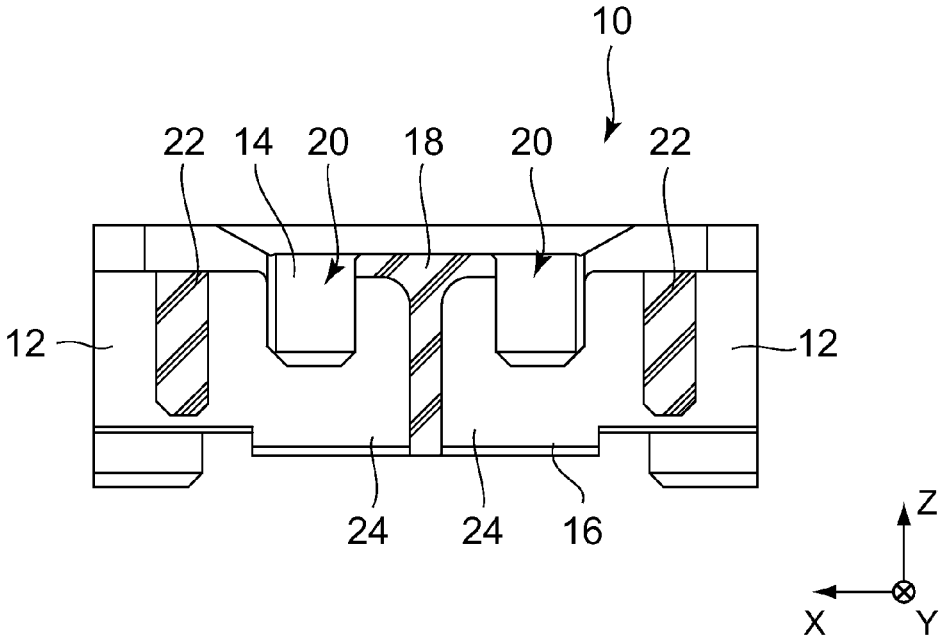
FIG. 11 is a cross-sectional view showing the housing of FIG. 9, taken along line F-F.

As shown in FIGS. 9 to 11, the housing 10 is formed with a plurality of terminal accommodation portions 24. As understood from FIGS. 1, 4, 9 and 11, the terminal accommodation portions 24 correspond to the terminals 40, respectively. As shown in FIGS. 9 and 10, the terminal accommodation portions 24 pierce the bottom portion 16 and communicate with the receiving portion 20. As shown in FIGS. 9 to 11, each terminal accommodation portion 24 is partially formed in the first wall portion 12 and the island portion 18, too. As shown in FIG. 11, the held portions 22 of the present embodiment are positioned within the terminal accommodation portions 24.

As shown in FIGS. 9 and 10, each first wall portion 12 is formed with two press-fit portions 26. Each press-fit portion 26 is positioned at one end of the first wall portion 12 in the Y-direction and is depressed inwards in the X-direction. Each second wall portion 14 is formed with a depressed portion 28. The depressed portion 28 is depressed inwards in the Y-direction.

Figure 16:
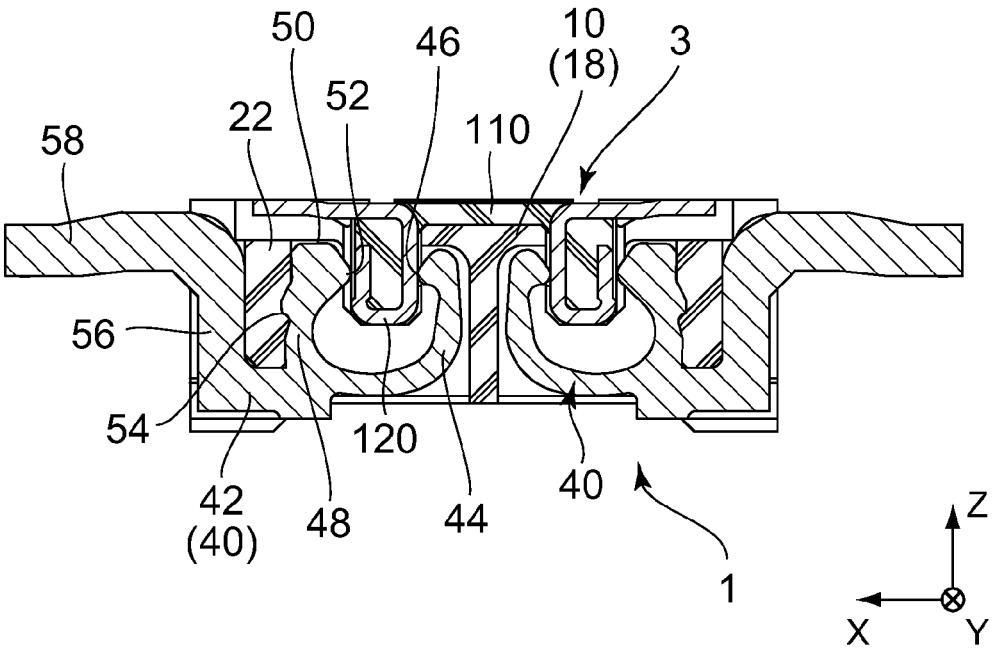
FIG. 16 is a view showing a state where the connector of FIG. 4 is mated with the mating connector of FIG. 15.

As shown in FIG. 16, the terminals 40 correspond to the mating terminals 120, respectively. As shown in FIG. 4, the terminals 40 are partially accommodated within the terminal accommodation portions 24, respectively.

Figure 12:
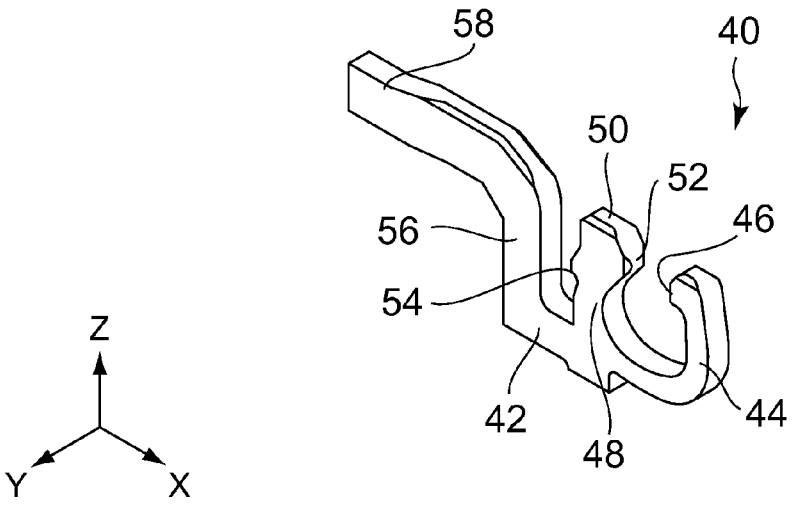
FIG. 12 is an oblique view showing a terminal included in the connector of FIG. 1.

As shown in FIG. 12, each terminal 40 is formed by stamping a metal plate but is not formed by bending or folding. In other words, the terminal 40 is a stamped member. As shown in FIGS. 4 and 12, each terminal 40 includes a base portion 42, a first portion 44, a second portion 48, a third portion 56 and a fixed portion 58. In detail, FIG. 12 shows one of the two terminals 40 shown in FIG. 4, which is positioned towards the positive X-side. The two terminals 40 shown in FIG. 4 have structures same as each other and are arranged in linear symmetry.

Figure 5:
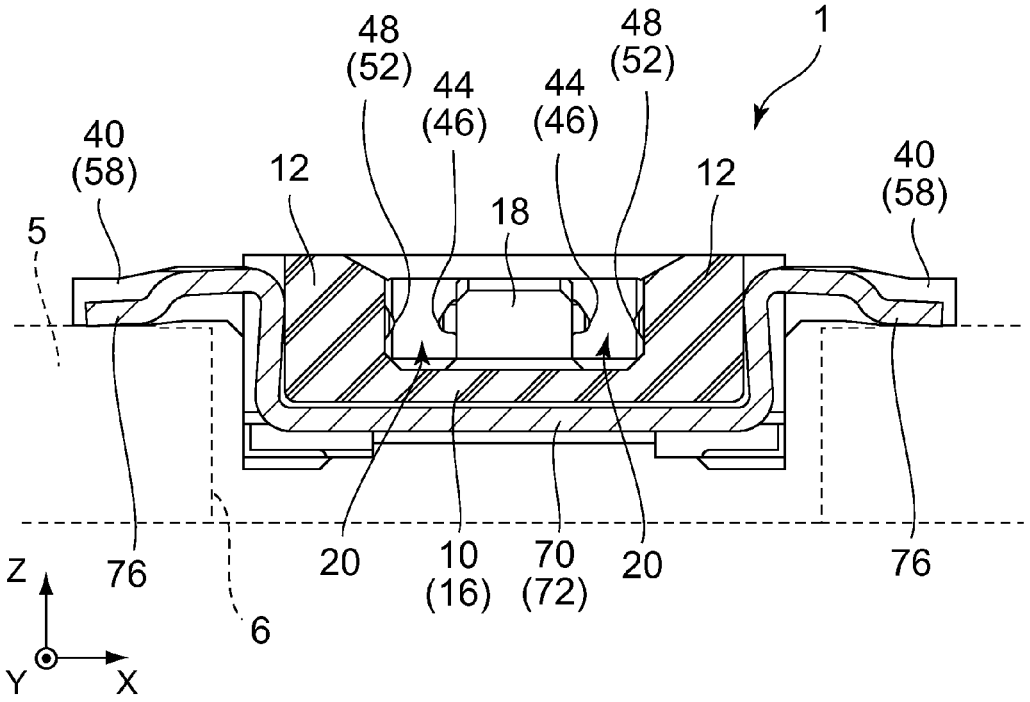
FIG. 5 is a cross-sectional view showing the connector of FIG. 3, taken along line B-B.

As shown in FIGS. 4 and 12, the first portion 44 has an L-like shape and is resiliently deformable. The first portion 44 extends directly from the base portion 42 inwards in the X-direction. The first portion 44 is provided with a first contact portion 46 which projects towards the second portion 48 in the X-direction. As shown in FIGS. 4 and 5, when the connector 1 is not mated with the mating connector 3, the first contact portion 46 projects within the receiving portion 20.

As shown in FIGS. 4 and 12, the second portion 48 extends directly from the base portion 42 in the Z-direction. The second portion 48 is provided with a second contact portion 52 and a press-fitting projection 54. In the Z-direction, a distance between an end portion 50 and the base portion 42 is larger than another distance between the press-fitting projection 54 and the base portion 42. In other words, in the Z-direction, the press-fitting projection 54 is positioned between the end portion 50 of the second portion 48 and the base portion 42. The second contact portion 52 projects towards the first portion 44 in the X-direction. In particular, as shown in FIGS. 4 and 5, the second contact portion 52 of the present embodiment projects within the receiving portion 20 when the connector 1 is not mated with the mating connector 3. Furthermore, as shown in FIGS. 4 and 12, the second contact portion 52 faces the first contact portion 46 in the X-direction. In other words, as shown in FIG. 4, nothing exists between the first contact portion 46 and the second contact portion 52 in the X-direction when the connector 1 is not mated with the mating connector 3. As shown in FIGS. 4 and 12, the press-fitting projection 54 projects towards the third portion 56 in the X-direction.

Figure 8:
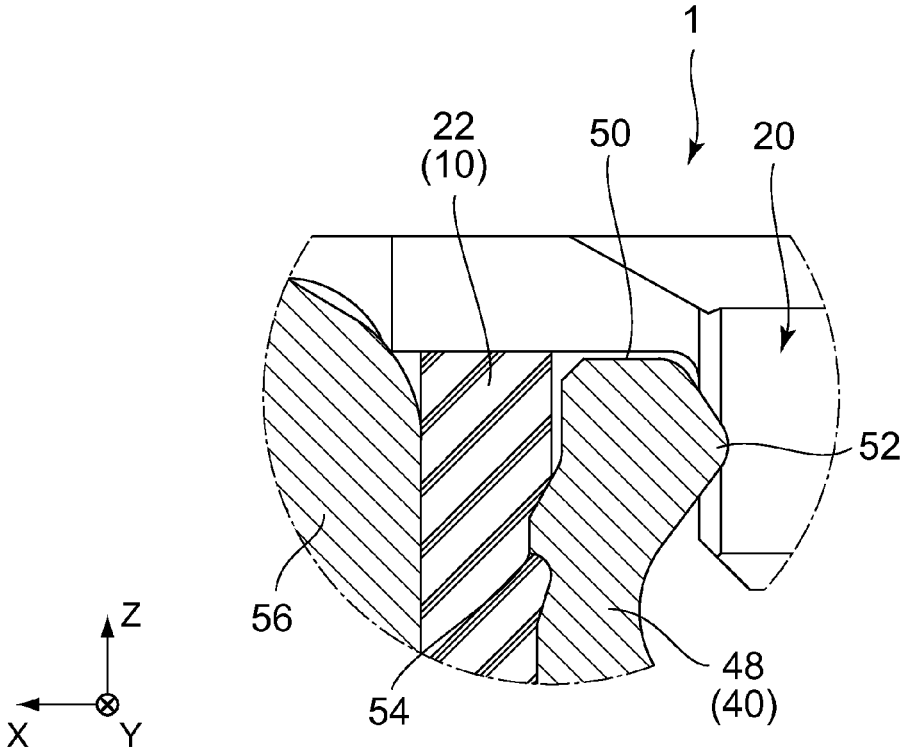
FIG. 8 is an enlarged view showing a part of the connector of FIG. 4, encircled by circle E.

As shown in FIGS. 4 and 12, the third portion 56 extends directly from the base portion 42 in the Z-direction. The second portion 48 and the third portion 56 are positioned away from each other in the X-direction. As understood from FIGS. 4, 11 and 12, each held portion 22 is inserted between the second portion 48 and the third portion 56 of the terminal 40 corresponding to the held portion 22, so as to be caught and held by the second portion 48 and the third portion 56. As best shown in FIG. 8, the end portion 50 of the second portion 48 of the present embodiment is positioned away from the held portion 22 in the X-direction.

As shown in FIG. 4, the fixed portion 58 is fixed to the circuit board 5, for example, by soldering when the connector 1 is mounted to the circuit board 5. As shown in FIGS. 4 and 12, the fixed portion 58 extends from the third portion 56 outwards in the X-direction. The fixed portion 58 is positioned away from the base portion 42 in the Z-direction. Therefore, as shown in FIG. 4, the connector 1 can be fixed to the circuit board 5 while the connector 1 is partially accommodated in the hollow portion 6 of the circuit board 5.

Figure 13:
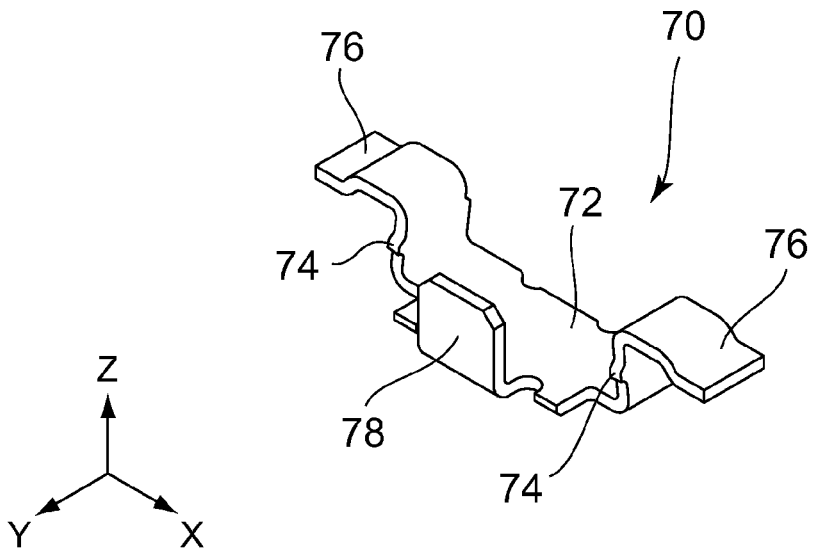
FIG. 13 is an oblique view showing a reinforcement member included in the connector of FIG. 1.
Figure 14:
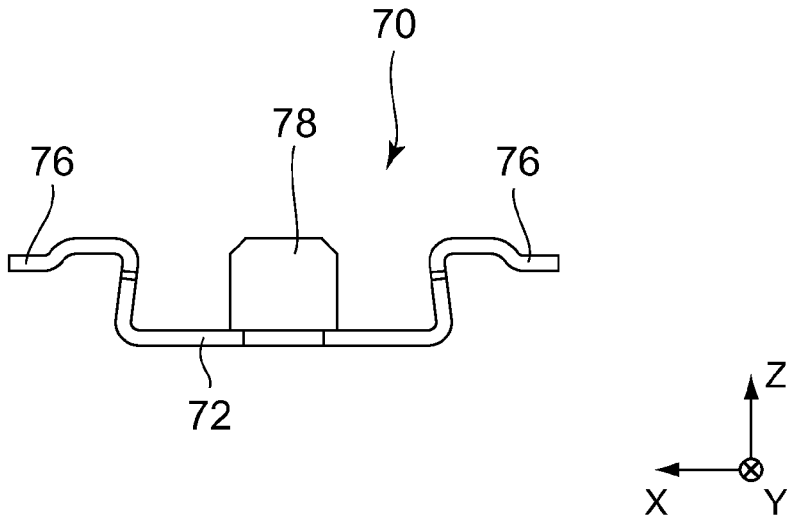
FIG. 14 is a side view showing the reinforcement member of FIG. 13.

As shown in FIGS. 13 and 14, each reinforcement member 70 includes a support portion 72, two securing portions 76 and one reinforcement piece 78. In detail, FIGS. 13 and 14 show one of the two reinforcement members 70 shown in FIG. 1, which is positioned towards the positive Y-side. The two reinforcement members 70 shown in FIG. 1 have structures same as each other and are arranged in linear symmetry.

As shown in FIGS. 13 and 14, the support portion 72 has a wide, angular-U shape. The support portion 72 is provided with press-fitting portions 74 projecting in the Y-direction. The securing portions 76 extend from the support portion 72 in directions opposite to each other in the X-direction. The reinforcement piece 78 extends from the support portion 72 in the Z-direction.

Figure 6:
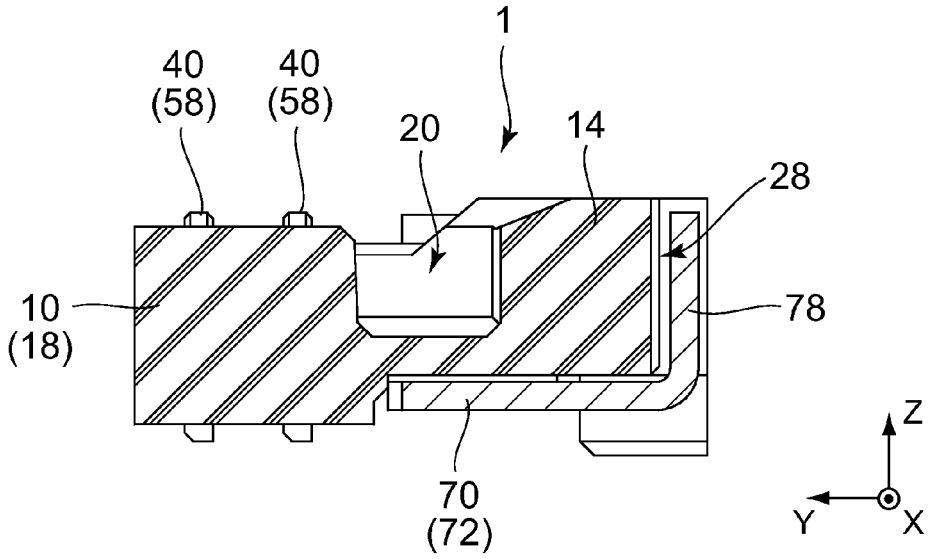
FIG. 6 is a cross-sectional view showing the connector of FIG. 3, taken along line C-C.
Figure 7:
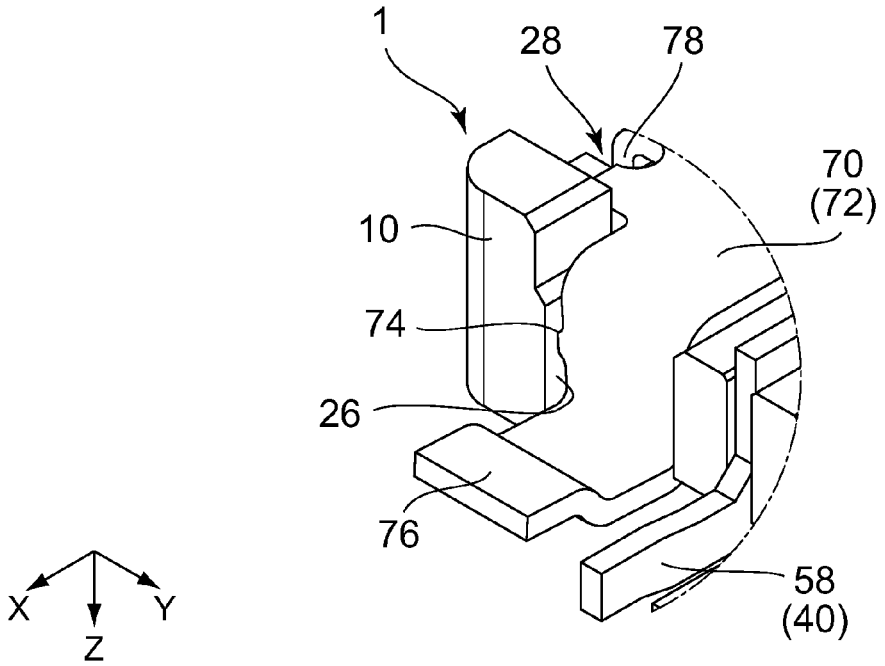
FIG. 7 is an enlarged view showing a part of the connector of FIG. 2, encircled by circle D.

As shown in FIGS. 1 and 2, the reinforcement members 70 are attached to the housing 10. As understood from FIGS. 2, 7 and 10, the press-fitting portions 74 are press-fit into the press-fit portions 26 and are held by the press-fit portions 26. As show in FIG. 5, the support portions 72 thus surround a part of the bottom portion 16 and parts of the first wall portions 12 of the housing 10 from outside thereof. As understood from FIGS. 1, 6 and 9, the reinforcement pieces 78 are received within the depressed portions 28. As shown in FIG. 6, the reinforcement pieces 78 are positioned close to and outside of the second wall portions 14 and reinforce the second wall portions 14, respectively. When the connector 1 is mated with the mating connector 3 (see FIG. 5), a part of the mating connector 3 might be in abutment with the second wall portion 14 to press the second wall portion 14 outwards in the Y-direction. Even in such case, since the reinforcement piece 78 reinforces the second wall portion 14, the second wall portion 14 can be prevented from being damaged.

As shown in FIG. 5, the securing portions 76 are fixed to the circuit board 5 when the connector 1 is mounted to the circuit board 5, so as to secure the support portion 72 to the circuit board 5. As shown in FIGS. 4 and 5, the connector 1 is disposed within the hollow portion 6 of the circuit board 5. Therefore, the circuit board 5 as such cannot support the connector 1 when the connector 1 is mated with the mating connector 3 (see FIG. 5). Instead, as understood from FIG. 5, the support portion 72 receives and supports the housing 10 when the connector 1 is mated with the mating connector 3.

As shown in FIG. 16, when the connector 1 is mated with the mating connector 3, each of the mating terminals 120 is interposed between the first contact portion 46 and the second contact portion 52 of the terminal 40 corresponding to the mating terminal 120, so that the press-fitting projection 54 is pressed against the held portion 22. As shown in FIG. 8, the end portion 50 of the present embodiment is positioned away from the held portion 22 in the X-direction before the connector 1 is mated with the mating connector 3. As shown in FIG. 16, when the connector 1 is mated with the mating connector 3, the end portion 50 is moved towards the held portion 22. Especially in the present embodiment, the end portion 50 is in contact with the held portion 22 when the connector 1 is mated with the mating connector 3. Accordingly, the press-fitting projection 54 is pressed against the held portion 22 more strongly so that the holding of the housing 10 by the terminal 40 is reinforced. Therefore, the housing 10 can be prevented from coming off the terminal 40 when the connector 1 is detached from the mating connector 3.

Second Embodiment

With reference to FIGS. 1 to 6 as well as FIGS. 17 to 22, a connector 1A according to a second embodiment of the present invention is a modification of the connector 1 of the above-mentioned first embodiment. The connector 1A is different from the connector 1 only in structures of reinforcement members 70A and parts therearound. In FIGS. 17 to 26, components same as the components already described with FIGS. 1 to 16 are depicted with reference numerals same as those of the same components; explanation about those components will be omitted. For example, the terminals 40 of the connector 1A are same as the terminals 40 of the aforementioned first embodiment. Likewise, a structural relation between a housing 10A and the terminals 40 of the connector 1A is same as a structural relation between the housing 10 and the terminals 40 of the aforementioned connector 1.

Figure 24:
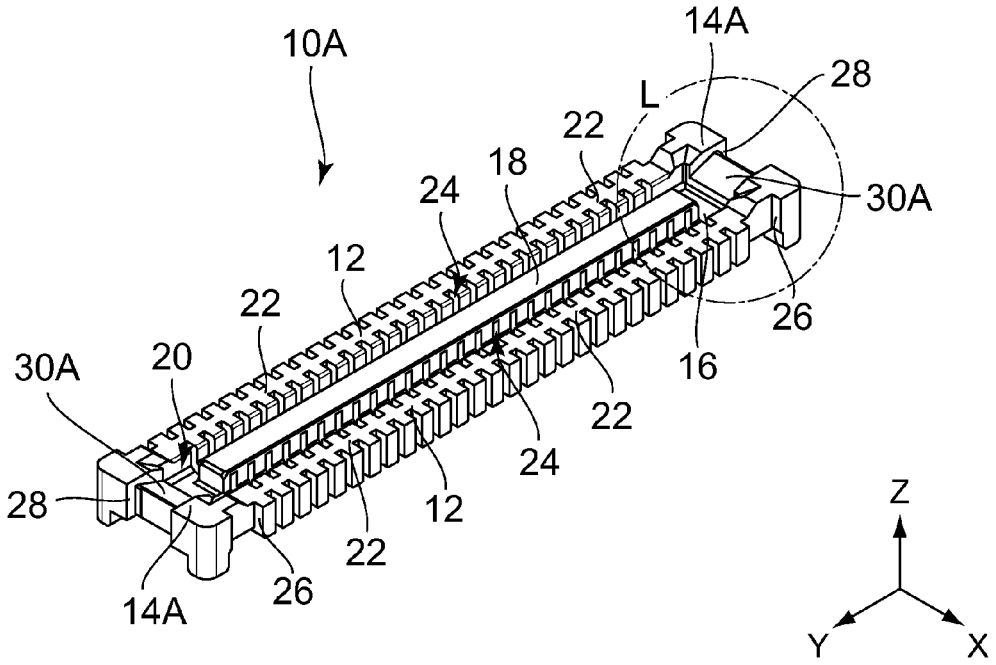
FIG. 24 is a top oblique view showing a housing included in the connector of FIG. 17.
Figure 25:
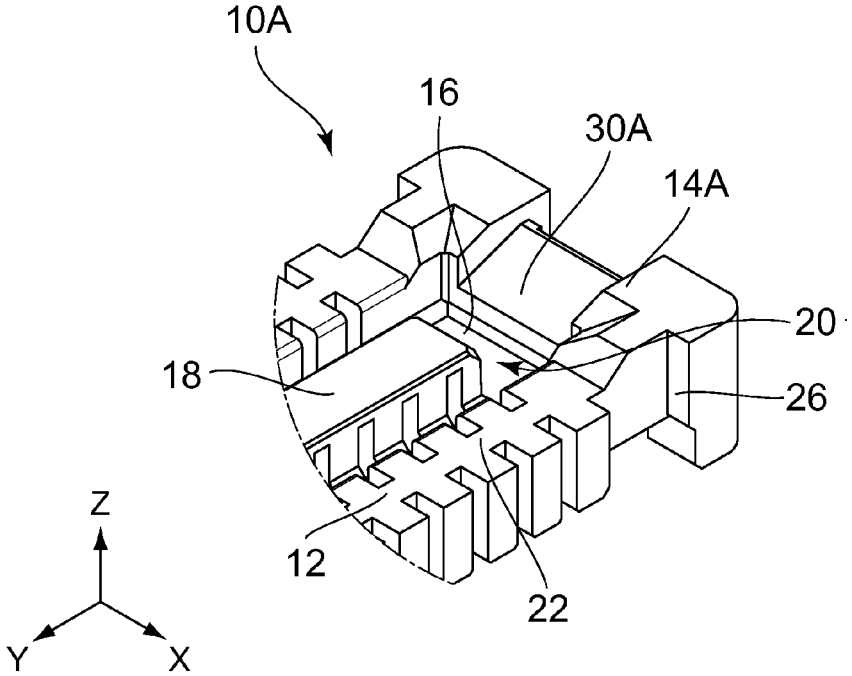
FIG. 25 is an enlarged view showing a part of the housing of FIG. 24, encircled by circle L.

As shown in FIGS. 24 and 25, second wall portions 14A of the housing 10A of the present embodiment are formed with retained portions 30A, respectively. Each of the retained portions 30A of the present embodiment is depressed in the Z-direction and has a slope extending towards the bottom portion 16.

Figure 17:
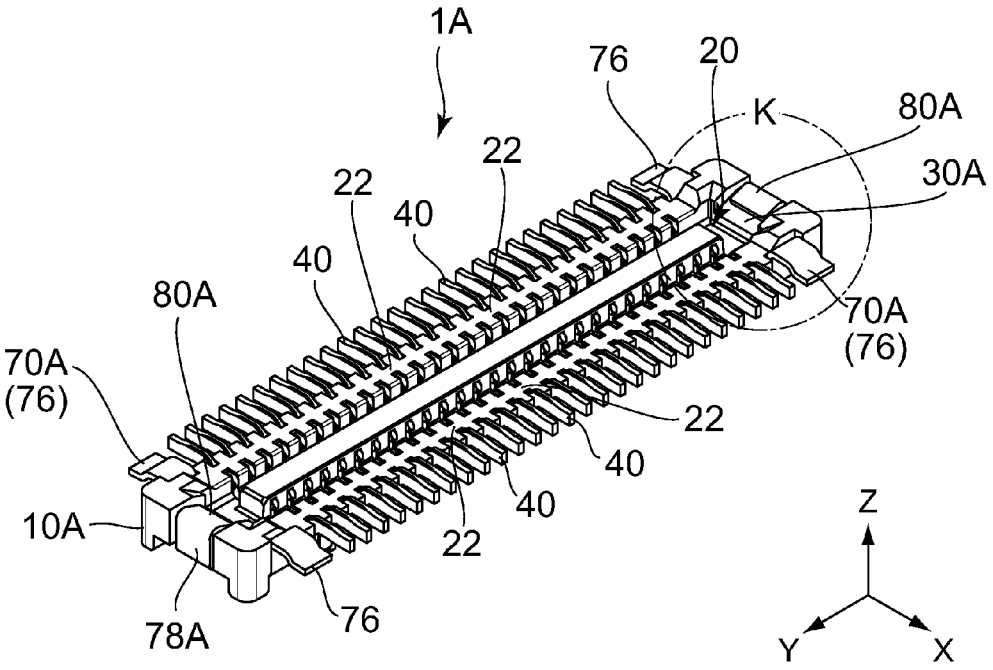
FIG. 17 is a top oblique view showing a connector in accordance with a second embodiment of the present invention.
Figure 18:
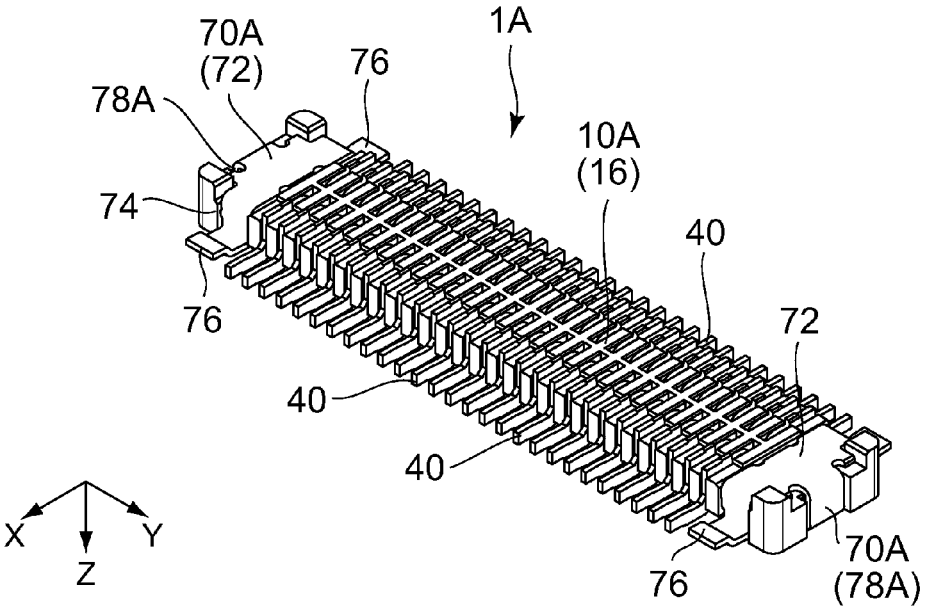
FIG. 18 is a bottom oblique view showing the connector of FIG. 17.
Figure 19:
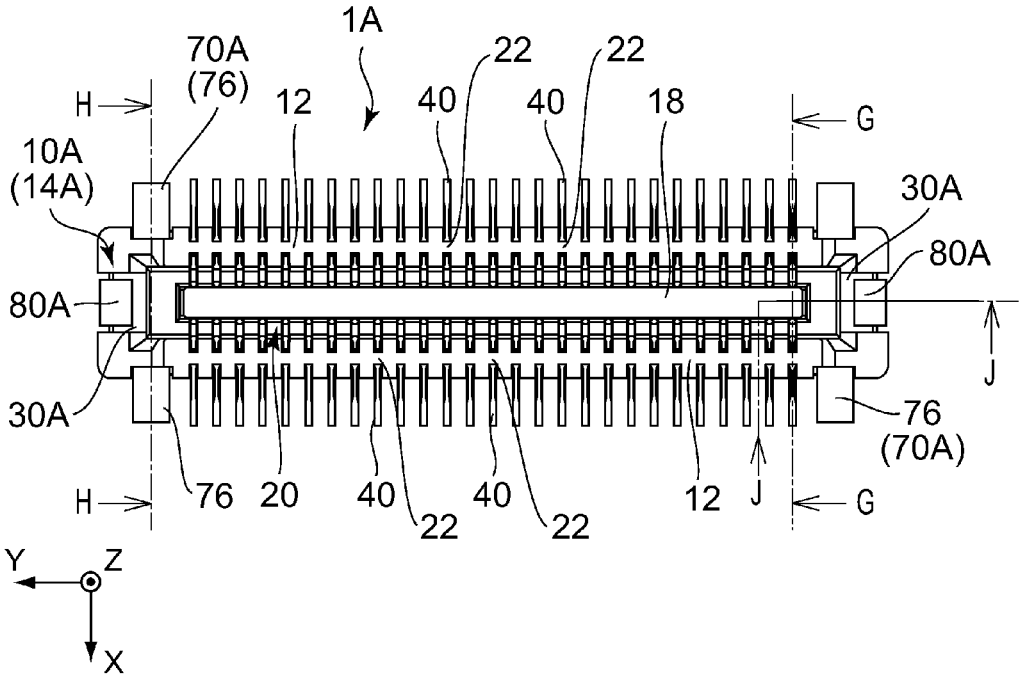
FIG. 19 is a top plan view showing the connector of FIG. 17.
Figure 20:
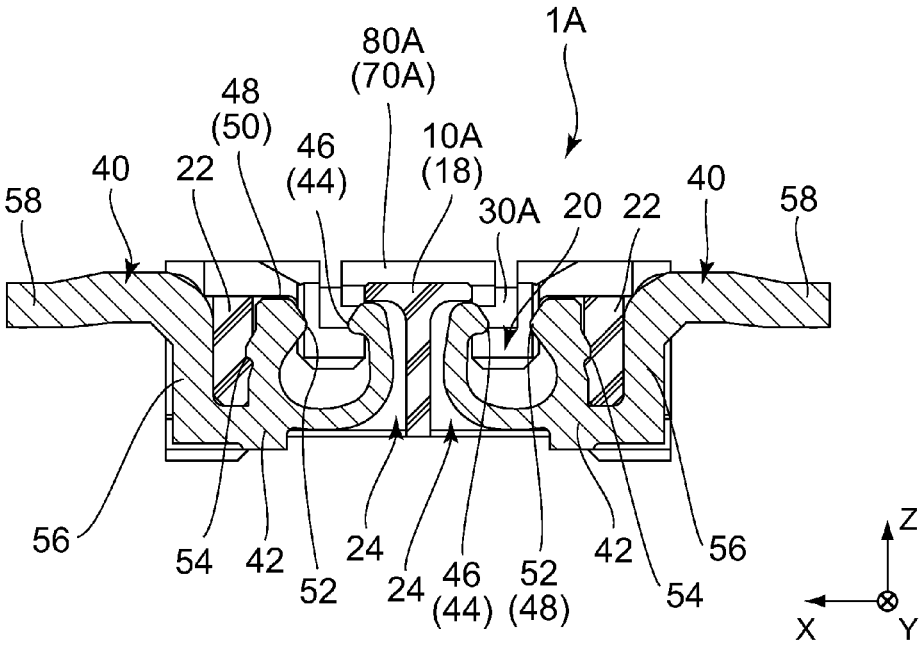
FIG. 20 is a cross-sectional view showing the connector of FIG. 19, taken along line G-G.
Figure 21:
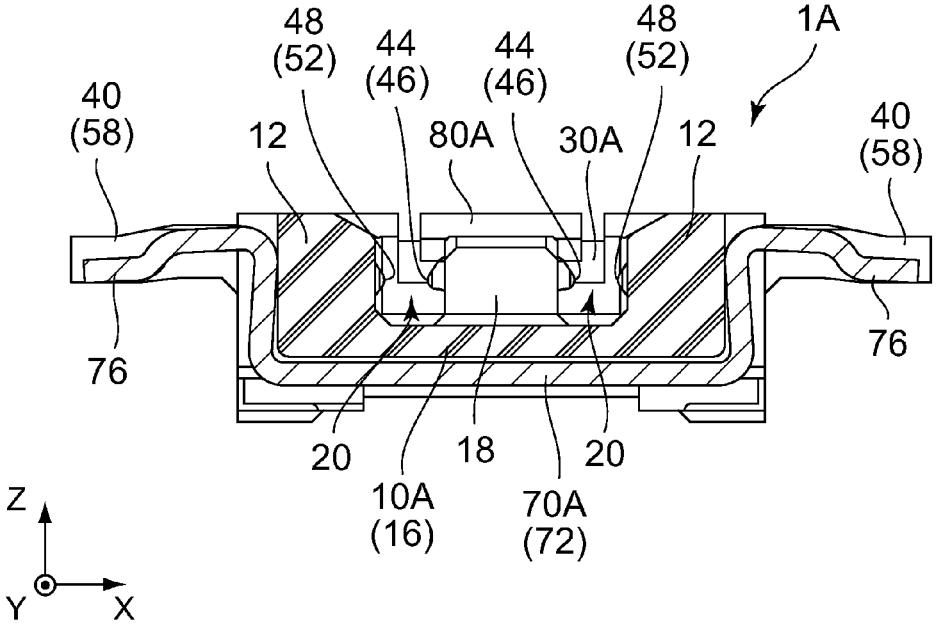
FIG. 21 is a cross-sectional view showing the connector of FIG. 19, taken along line H-H.
Figure 22:
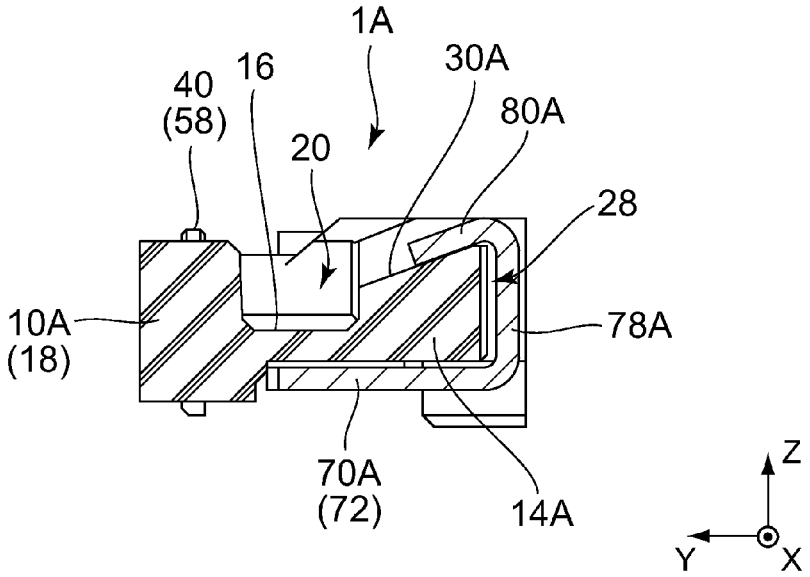
FIG. 22 is a cross-sectional view showing the connector of FIG. 19, taken along line J-J.
Figure 23:
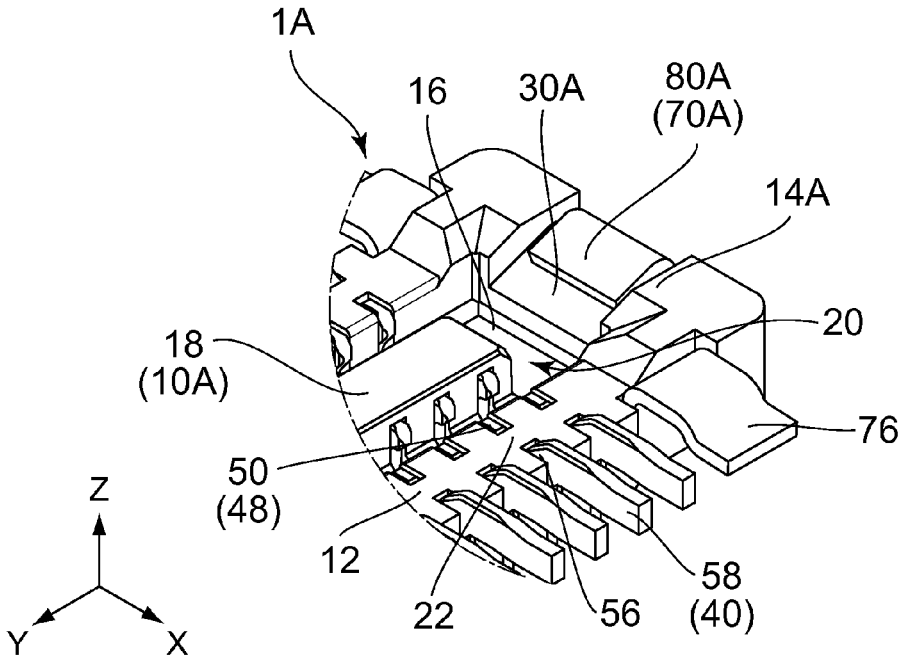
FIG. 23 is an enlarged view showing a part of the connector of FIG. 17, encircled by circle K.
Figure 26:
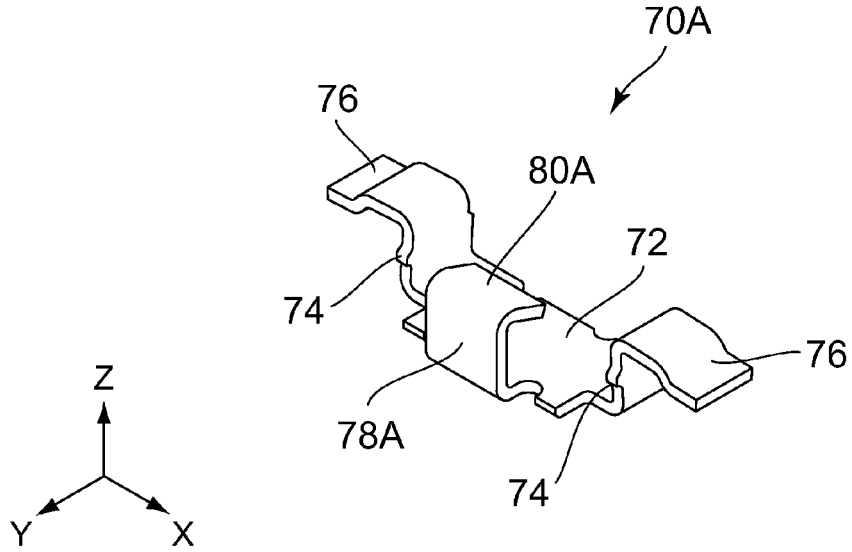
FIG. 26 is an oblique view showing a reinforcement member included in the connector of FIG. 17.
Figure 27:
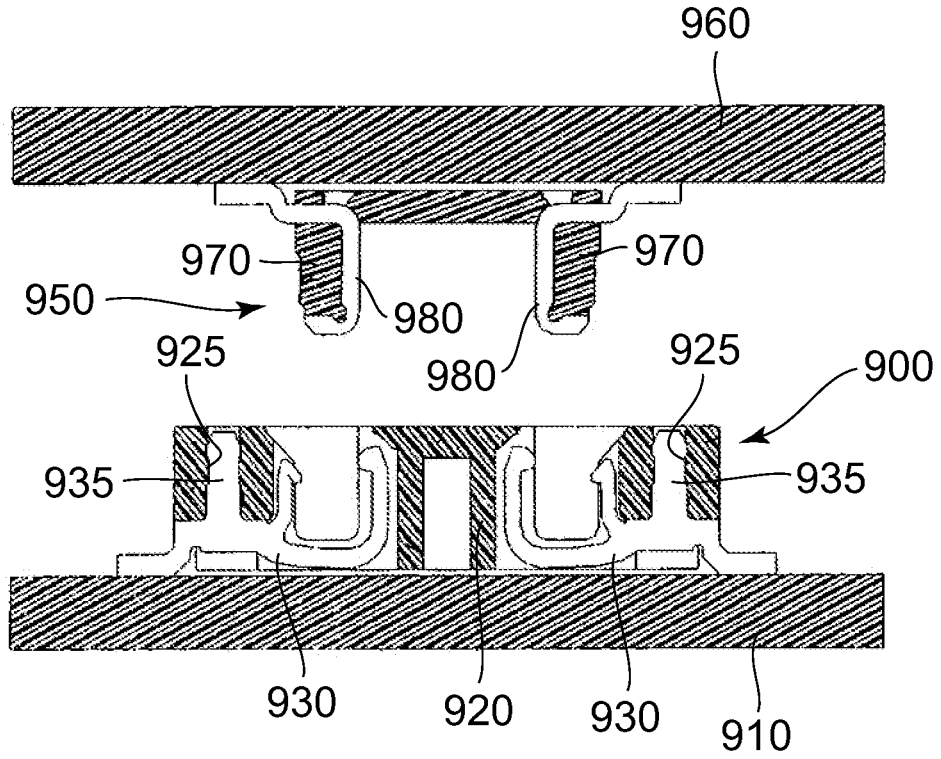
FIG. 27 PRIOR ART
FIG. 27 is a view showing a connector and a mating connector of Patent Document 1.

As shown in FIGS. 17 and 26, each reinforcement member 70A is further provided with a retaining portion 80A which extends from a reinforcement piece 78A along a direction oblique to both the Y-direction and the Z-direction. As shown in FIG. 17, when the reinforcement members 70A are attached to the housing 10A, the retaining portions 80A project towards each other in the Y-direction. As best shown in FIG. 22, each retaining portion 80A is positioned away from the support portion 72 in the Z-direction. As shown in FIGS. 22 and 23, the retaining portion 80A extends along the retained portion 30A towards the bottom portion 16. As shown in FIG. 22, the retained portion 30A of the second wall portion 14A is positioned between the retaining portion 80A and the support portion 72. Therefore, it can be prevented that, when the connector 1 is detached from the mating connector 3, the housing 10A follows up the mating connector 3 so as to come off the reinforcement member 70A.

The connectors 1, 1A according to the aforementioned embodiments can be modified variously. For example, although each of the housings 10, 10A according to the aforementioned embodiments is provided with the depressed portions 28, the depressed portions 28 may not be provided. In addition, the retained portions 30A may have surfaces perpendicular to the Z-direction, instead of the slopes.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a first direction, comprising:

a housing including a plurality of held portions; and a plurality of terminals corresponding to the held portions, respectively, wherein:

each of the terminals includes a base portion, a first portion, a second portion and a third portion;

the first portion extends directly from the base portion and is provided with a first contact portion which projects towards the second portion in a second direction perpendicular to the first direction;

the second portion extends directly from the base portion and is provided with a second contact portion and a press-fitting projection;

the second contact portion projects towards the first portion in the second direction and faces the first contact portion;

the press-fitting projection projects towards the third portion in the second direction;

the third portion extends directly from the base portion;

each of the held portions is held by the second portion and the third portion of the terminal corresponding thereto;

the mating connector includes a plurality of mating terminals which correspond to the terminals, respectively;

when the connector is mated with the mating connector, each of the mating terminals is caught between the first contact portion and the second contact portion of the terminal corresponding thereto so that the press-fitting projection is pressed against the held portion;

the second portion has an end portion;

in the first direction, a distance between the end portion and the base portion is greater than another distance between the press-fitting projection and the base portion;

before the connector is mated with the mating connector, the end portion is located away from the held portion in the second direction; and when the connector is mated with the mating connector, the end portion is moved to or towards the held portion.

2. A connector mateable with a mating connector along a first direction, comprising:

a housing including a plurality of held portions; and a plurality of terminals corresponding to the held portions, respectively, wherein:

each of the terminals includes a base portion, a first portion, a second portion and a third portion;

the first portion extends directly from the base portion and is provided with a first contact portion which projects towards the second portion in a second direction perpendicular to the first direction;

the second portion extends directly from the base portion and is provided with a second contact portion and a press-fitting projection;

the second contact portion protects towards the first portion in the second direction and faces the first contact portion;

the press-fitting projection protects towards the third portion in the second direction;

the third portion extends directly from the base portion in the first direction;

each of the held portions is held by the second portion and the third portion of the terminal corresponding thereto;

each of the terminals is provided with a fixed portion which is fixed to a circuit board when the connector is mounted to the circuit board; and the fixed portion extends from the third portion and is located away from the base portion in the first direction.

3. The connector as recited in claim 2, further comprising two reinforcement members attached to the housing, wherein:

each of the reinforcement members includes a support portion and two securing portions;

the support portion receives and supports the housing upon the mating of the connector with the mating connector;

the securing portions extend oppositely to each other from the support portion in the second direction; and the securing portions are fixed on the circuit board to secure the support portion to the circuit board when the connector is mounted to the circuit board.

4. The connector as recited in claim 3, wherein:

the housing has two first wall portions and two second wall portions;

the first wall portions are located away from each other in the second direction;

each of the first wall portions includes the held portions;

the second wall portions are located away from each other in a third direction perpendicular to both the first direction and the second direction;

each of the second wall portions connects the first wall portions in the second direction;

the reinforcement members are further provided with reinforcement pieces, respectively; and the reinforcement pieces extend from the support portions in the first direction and are positioned outside and close to the second wall portions in the third direction to reinforce the second wall portions, respectively.

5. The connector as recited in claim 4, wherein:

the reinforcement members are further provided with retaining portions, respectively, which project from the reinforce pieces towards each other in the third direction;

the retaining portions are located away from the support portions in the first direction; and the second wall portions are located between the retaining portions and the support portions.

* * * * *